United States Patent [19]

Alexander

[11] 4,122,620

[45] Oct. 31, 1978

[54] DEVICE FOR USE IN DEACTIVATING FIREARMS

[76] Inventor: Clifton J. Alexander, 14A Caffray Ave., Aramoho, Wanganui, New Zealand

[21] Appl. No.: 803,757

[22] Filed: Jun. 6, 1977

[30] Foreign Application Priority Data

Jun. 17, 1976 [NZ] New Zealand ..... 181190

[51] Int. Cl.[2] ..... F41C 27/00

[52] U.S. Cl. ..... 42/1 LP

[58] Field of Search ..... 42/1 LP, 1 Y

[56] References Cited

U.S. PATENT DOCUMENTS

| | | | |
|---|---|---|---|
| 835,349 | 11/1906 | Deming | 42/1 LP |
| 1,513,267 | 10/1924 | Parks | 42/1 LP |
| 2,512,140 | 6/1950 | Childs et al. | 42/1 Y |
| 3,031,787 | 5/1962 | Womble, Jr. | 42/1 Y |
| 3,139,694 | 7/1964 | Schaefer | 42/1 Y |
| 3,774,333 | 11/1973 | Reynolds | 42/1 LP |

*Primary Examiner*—Charles T. Jordan

*Attorney, Agent, or Firm*—Holman & Stern

[57] ABSTRACT

A firearm securing device which includes two members which are pivoted with respect to each other and which can be locked around a firearm. One of the members includes a protruding portion which when the two members have been locked will interfere with the normal action of the firearm in question, for example by protruding into the breech, the ejection chamber, or in the case of a shotgun by protruding to a position where the shotgun cannot be closed for use. The invention also includes provision for securing the device against removal from some anchoring point.

10 Claims, 4 Drawing Figures

DEVICE FOR USE IN DEACTIVATING FIREARMS

BACKGROUND OF THE INVENTION (1) Field of the Invention

This invention relates to a device for use in deactivating firearms which should lead to increased safety with firearms especially during the storage thereof.

(2) Description of the Prior Art

Most accidents with firearms tend to happen as a result of abuse of the firearm by children or the like who find the firearm an interesting and thrilling plaything. Traditionally the means whereby a firearm is deactivated is to remove the bolt from the firearm. However, with modern rifles coming in many different varieties, for example, lever action, semi-automatic or pump action, such a form of deactivation is not available. Moreover by removing the bolt or any other component of a firearm, dust enters the delicate mechanism thus making the cleaning of the rifle or other firearm necessary before use.

There is a need for some means whereby guns can be secured against firing and optionally also secured against removal so that enhanced safety results so that even if the ammunition is to hand, the rifle is completely safe.

One earlier attempt at a device of this type was made and this has been disclosed and claimed in New Zealand Patent specification No. 162369. The device of this New Zealand Patent specification however, while resulting in a securing of a firearm is difficult to use if in fact it is to be applied to different guns.

SUMMARY OF THE INVENTION

The present invention is adapted to provide means and a method for securing firearms which will go at least some way to meet the abovementioned desiderata or which will at least provide the public with a useful choice over existing safety devices.

Accordingly in one aspect the present invention consists in a device for securing a firearm comprising:

a first member which includes a projecting portion, a second portion hingeably associated with said first member capable of having a free end thereof moved towards or away from said first member so that when moved away a firearm can be positioned between the two members and when moved together such a firearm is encircled, each of the said members including means to facilitate the locking of the two members together so as to hold them in an encircling relationship with any firearm positioned therebetween, the construction and arrangement being such that when the firearm is thus located between the two members said projecting portion interferes with the operation of the firearm.

In a further aspect the present invention consists in combination a device as defined in the preceding paragraph when in combination with means capable of being received in one of said members to thereby become fixably associated therewith to provide said fixable association.

In still a further aspect the present invention consists in a method of securing a firearm which involves the operative use of a device as defined in the penultimate paragraph so as to leave said firearm encircled by said first and second member in their locked condition with said protruding portion interfering with the operation of the firearm.

Preferably said first and second members function substantially in the manner of a manacle of a pair of handcuffs.

BRIEF DESCRIPTION OF THE DRAWINGS

The preferred embodiment of the present invention is shown in the accompanying drawing in which.

Figure 1:
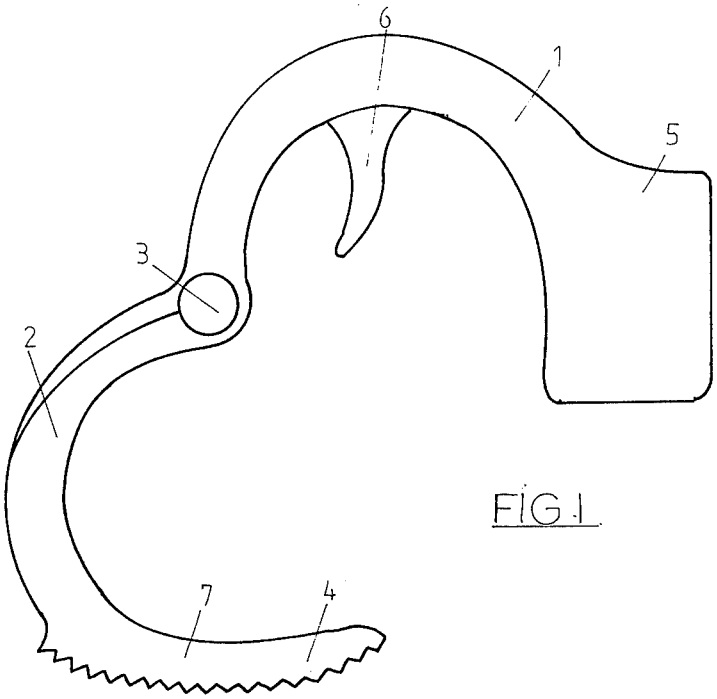
FIG. 1 is a side view of the preferred device in accordance with the present invention showing the two members in their open or said away position which allows a firearm to be placed therebetween and for the device to be closed so as to encircle the same.

In the preferred form of the present invention the first member 1 is similar to a portion of one manacle of a pair of handcuffs. This portion 1 persons skilled in the art will realize comprises two members forming a bifurcation defining a space through which the second member 2 can swing under the pivot action of the pivot or hinge 3 so that the free end 4 of the member 2 can pass through the spaced apart portions of the member 1 to enable a return by completing a circuit about the pivot 3 to the position shown substantially in the drawing. The member 1 is made up of the two spaced apart portions which are held in their spaced apart portion by an integral portion 5 which is not contacted by the free end 4 of the member 2 and by the effect of the member 2 being interposed between the components or spaced apart portions of the member 1.

The two members are formed from a hardened steel so as to resist hacksawing and the like.

The projecting portion 6 of the present invention is preferably attached to one only of the two spaced apart portions of the member 1. This projecting portion 6 as can be seen in the drawing is directed inwards so as to impinge upon an article which is enclosed by the encircling members 1 and 2. The convenience of using the device of the present invention will be apparent having regard to the ratchet teeth 7 and the fact that the free end 4 can be pushed home into the portion 5 where it engages the ratchet teeth 7 with the appropriate pawl or detent which is lockably controllable by a key which is insertable at some appropriate place into the portion 5 of the member 1.

In some preferred forms of the present invention, the portion 5 will include means or other provision for receiving the end of a securing chain, wire or the like so that the device itself while deactivating a firearm can be lockably secured so that any firearm secured thereby is secured not only against firing but also against removal.

Preferably the thickness of the second member is 5 mm while the thickness of each bifurcating member is 3 mm. Ideally the space between the bifurcating members is 5.5 mm.

Preferably the distance from the pivot 3 to teeth 7 of the second member is substantially 68 mm.

Preferably the projecting distance of the projecting portion 6 from the region of the first member from which it projects is substantially 30 mm. Preferably that distance substantially defines the radius of the inner curve of the first member.

Figure 2:
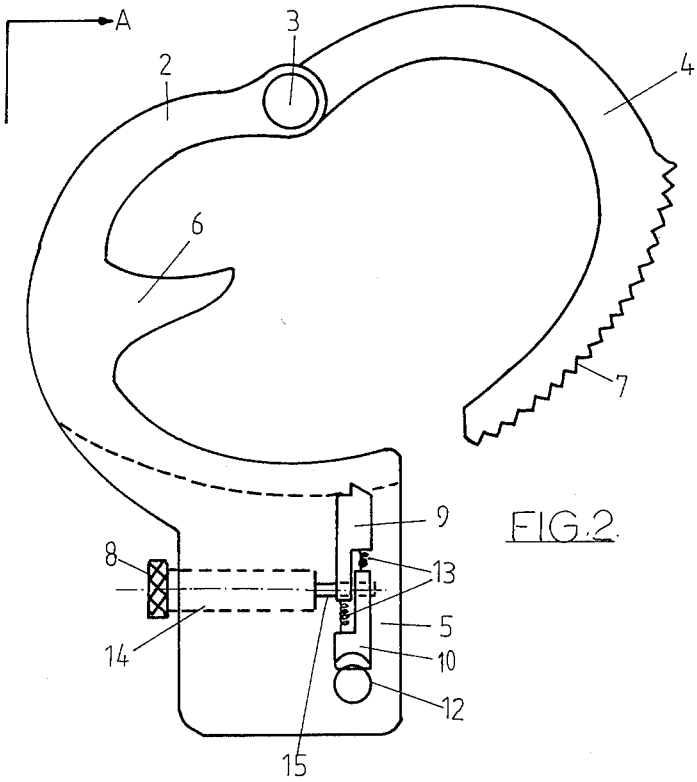
FIG. 2 is a similar view to that shown in FIG. 1 but showing diagrammatically means capable of being actuated by a key to release one from its lockable ratchet engagement with said second member and to release the other from its engagement with a shoulder on a pin or the like associated with means for anchoring the device against removal.
Figure 3:
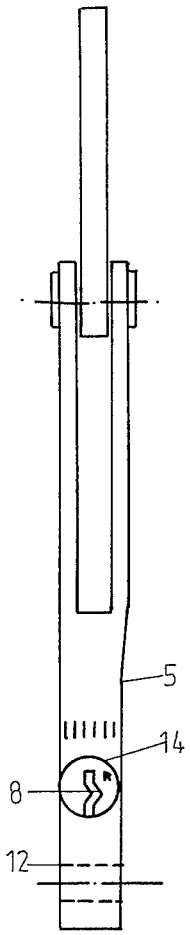
FIG. 3 is an end view taken in the direction AA with respect of FIG. 2 but showing the device with the second member swung further away so as to demonstrate its pivotal association with the bifurcations of a portion of said first member.

Preferably the portion 5 is 10 mm thick, 38 mm wide and at least 24 mm from its outer facing edge to the portion where the keyhole 8 of the form of the present invention shown in FIGS. 2 and 3 is positioned. A description of the preferred key and locking arrangement will now be made having regard to FIG. 2 and FIG. 3.

Slidably related and positioned within an appropriate guiding bore in the portion 5 are two members 9 and 10 which are respectively adapted to lock onto the teeth 7 of the first member and at least one shoulder 19 of a member 11 capable of being received in an aperture 12 that passes through the member 5. Associated with the two members 9 and 10 are appropriate spring means 13 adapted to make engaging portions of each of those members project to a position where a lockable engagement of the type envisaged can occur.

Disposed at substantially right angles therewith is a key actuable barrel member 14 including said key hole 8. This barrel has at the end thereof a protruding portion 15 which is offset from the central axis of the barrel 14. A person skilled in the art therefore will appreciate that when the appropriate key is inserted in the keyhole 8 that appropriate surfaces associated with the members 9 and 10 can follow the portion 15 in the nature of cam followers so that a differential movement occurs which could displace one or other of the members 9 and 10 against its biassing spring means 13 so as to release selectively depending upon the direction of turning of the key either the teeth of the ratchet engaging means 7 or a shoulder 19 of the member 11.

A person skilled in the art will appreciate the desirability of requiring only a single key and also the added desirability of it being necessary to insert the key into a single keyhole.

In other forms of the present invention however a combination locking means could be utilized to hold the first and second member in its locking engagement. Preferably also a or the same combination locking means could also be utilized to effect locking on a pin like member 11.

Figure 4:
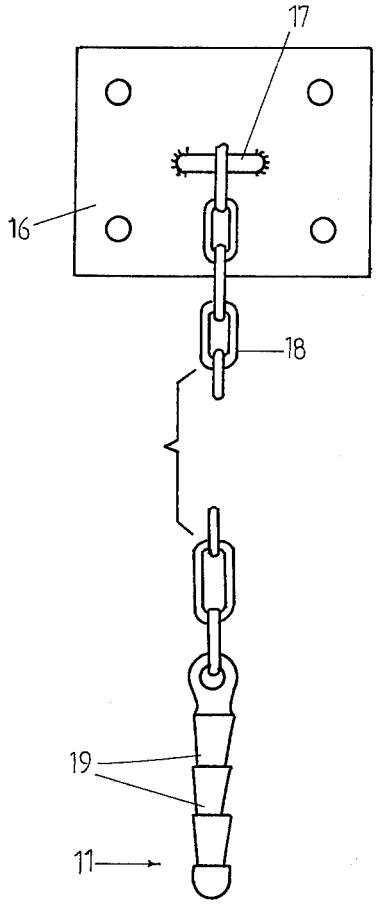
FIG. 4 shows a preferred anchoring means which includes means for being anchored to an anchoring surface and flexible means (in this case a chain) which is secured to a pin or means capable of being fixedly associated in a lockable manner with the device.

In FIG. 4 there is shown a plate preferably 50 × 40 mm in diameter and 3 mm thick which has four 4 mm diameter holes therein. This plate 16 preferably has mounted therefrom by an appropriate eyelet member or the like 17 a chain 18 which is connected to the member 11. A person skilled in the art will appreciate how such a plate 16 can be anchored to an anchoring surface for example by appropriate screws or the like. Ideally such screws would be spot welded or the like to prevent or at least seriously hinder the removal thereof. A person skilled in the art will appreciate that ideally the steels or other materials from which the components of the device and/or the securing or anchoring means of the present invention are manufactured are ones that would resist easy tampering. Hence it can be seen that the operative use of the device of the present invention a firearm can be secured both against being operated and also against being removed.

The operation of the device will now be described with regard to the drawings.

With a bolt actioned rifle, the device would be taken in a condition as shown in FIG. 1 and the bolt of that rifle would be opened to reveal the breech. The rifle would be inserted between the two members so that the projecting member 6 is in the firing chamber or breech in advance of the bolt. The free end 4 of the member 2 would then be closed around the firearm and lockably received as tightly as possible into the portion 5 of the member 1, thus securing the firearm. Of course the device itself could then be secured against removal.

With the bolt action with other forms of rifle, for example semi-automatic, pump action or lever action the easiest way of securing these is to similarly encircle the rifle but with the projecting member 6 inserted into the ejection chamber so as to interfere with the movement of the firing block or other mechanism that moves therethrough. A person skilled with each type of rifle would appreciate that the member 6 would have to be inserted at a particular stage of the pumping or levering mechanism of the rifle.

With a shotgun, the member 6 can similarly be inserted into the ejection chamber if in fact the shotgun is a pump action or semi-automatic. With a single barrel or double barrel conventional shotgun however, the device could be used to encircle the shotgun when in its broken open form to prevent the reclosing thereof, thus effectively deactivating the gun. Similarly with pistols, the member 6 could interfere with the movement of the hammer of a revolver or with the ejection chamber of automatics.

From the foregoing then it can be seen that the present invention provides a useful alternative to other rifle and other firearm deactivating devices.

The advantages of the present invention comprise the following:

(a) it is a one piece unit, (b) it is self fastening and can be manufactured either with or without an integral lock, (c) it works on the ratchet principal which allows it to automatically adjust to all sizes of weapons, (d) the obstructing lug is carefully positioned so as to make adjustments to that part unnecessary, (e) the device when in position can be further secured to prevent theft, (f) the device will fit all types of sporting weapons and most hand guns. Most if not all of these advantages are available using almost all forms of the device in accordance with the present invention.

From the foregoing then it can be seen that the present invention provides means and/or a method which will go at least some way to improve the safety record of firearms when stored by being effective in preventing the unauthorised operation thereof and in some cases the unauthorized removal thereof.

What I claim is:

1. A device for securing a firearm comprising:

a first member which includes a projecting portion, a second member hingeably associated with said first member and capable of having a free end thereof moved towards or away from said first member so that when moved away a firearm can be positioned between the two members and when moved together such a firearm is encircled, each of the said members including locking means to facilitate the locking of said members together so as to hold them in an encircling relationship with a firearm positioned therebetween, the construction and arrangement being such that when the firearm is thus located between said members said projecting portion interferes with the operation of the firearm, said first and second members being mutually lockable together whereby said members can only be separated under the action of a key and wherein a ratchet engagement is provided between said first and second members so that when they are being locked together the position of each member can be adjusted to more accurately encircle the firearm in question, the ratchet engagement being such as to allow tightening of the two members around a firearm and not to allow the release of the same unless the locking means by which two members are mutually lockable is released.

2. A device as claimed in claim 1 wherein the device is dimensioned and shaped so that when in a locked condition said projecting portion can be received in a breech of a bolt actioned firearm, can be received in an ejection chamber of a semi-automatic, lever action or pump action of a firearm or be so positioned as to interfere with the closing of a shotgun.

3. A device as claimed in claim 1 wherein a portion of said first member is bifurcated and said second member is hinged so as to have a portion thereof between the distal end of the bifurcation and such that said second member can if not obstructed by an object positioned between said first and second member be swung completely through the bifurcation of said first member.

4. A device as claimed in claim 3 wherein said first member includes a plurality of teeth engageable by a member which is movable with respect to said second member in which it is mounted under the action of a key to provide said ratchet engagement.

5. A device as claimed in claim 4 wherein means is provided on one of said members capable of receiving some member which will fixedly associate therewith under the action of a locking device so that any firearm secured by said device can also be secured against unauthorized removal.

6. A device as claimed in claim 5 wherein the fixable association is controllable under the action of a key.

7. A device as claimed in claim 6 where both said fixable association and the ratchet engagement can be released by the turn of a single key in a key hole, the release of said fixable association being achieved by turning the key in one direction and the release of said ratchet engagement being achieved by the turning of the key in the other direction.

8. In combination a device as claimed in claim 5 when in combination with means capable of being received in one of said members to thereby become fixably associated therewith to provide said fixable association.

9. A combination as claimed in claim 8 wherein said last mentioned means is a member having a shoulder which can be locked to prevent withdrawal of the same from said fixable association, which said last mentioned member has attached thereto means to be anchored to hinder the removal of the same.

10. A combination as claimed in claim 9 wherein said last mentioned means comprises a chain member and means to anchor one end of said chain member to an anchoring surface.

* * * * *